United States Patent [19]

DiFiore

[11] Patent Number: 4,523,875

[45] Date of Patent: Jun. 18, 1985

[54] AUXILIARY DRAINAGE SYSTEM FOR ELIMINATING WATER PROBLEMS ASSOCIATED WITH A FOUNDATION OF A BUILDING

[76] Inventor: Dante DiFiore, 5387 Wilson Mills Rd., Highland Heights, Ohio 44143

[21] Appl. No.: 453,129

[22] Filed: Dec. 27, 1982

[51] Int. Cl.[3] ..... E02B 11/00; E02D 19/00; E04D 13/08

[52] U.S. Cl. ..... 405/50; 52/12; 52/16; 52/169.5; 210/446

[58] Field of Search ..... 405/36, 43–45, 405/50, 51, 229, 48; 52/12, 16, 169.1, 169.5, 742, 169.14; 210/162, 163, 446, 451

[56] References Cited

U.S. PATENT DOCUMENTS

| | | | |
|---|---|---|---|
| 870,433 | 11/1907 | Hodges | 405/50 |
| 1,552,902 | 9/1925 | Werner | 210/446 X |
| 1,734,777 | 11/1929 | Pike | 52/169.5 |
| 3,628,668 | 12/1971 | Hippert | 52/12 X |
| 3,668,829 | 6/1972 | Nelson | 52/169.5 |
| 4,142,344 | 3/1979 | Palmaer | 52/169.5 X |

FOREIGN PATENT DOCUMENTS

| | | | |
|---|---|---|---|
| 29400 | 5/1981 | European Pat. Off. | 52/169.5 |
| 2908621 | 9/1980 | Fed. Rep. of Germany | 52/16 |

*Primary Examiner*—Cornelius J. Husar
*Assistant Examiner*—Nancy J. Stodola

[57] ABSTRACT

An auxiliary drain line is laid in a trench which extends about lower foundation portions of an existing building but at locations preferably spaced several feet from the foundation. The newly laid auxiliary drain line is formed of perforate material which admits surrounding ground water, and is connected to a storm drain line that serves the building so that water which enters the auxiliary drain line is discharged into the storm drain line. A porous reservoir is formed in the trench to (1) duct ground water to the auxiliary drain line, (2) eliminate ground water pressure buildup in the vicinity of the foundation wall, and (3) provide a ground water reservoir during an excessively heavy rainfall when the storm drain line may be incapable of carrying away all of the accumulated waterfall. The auxiliary drain line is laid in the trench at a level below the top of the basement floor of the building. In the event the storm drain line is found to be positioned too high to permit the auxiliary drain line to discharge into it properly, (1) a manhole is constructed, (2) the auxiliary drain line is connected to discharge into the manhole, and (3) a sump pump is provided in the manhole for transferring water from the manhole to the storm drain line. Branch lines may be installed in short underground tunnels to connect the new auxiliary drain line with an existing footer drain line system which surrounds the foundation of the building. The building's downspouts may be rerouted to the auxiliary drain line as needed to bypass clogged storm drain line sections. The building's downspouts are preferably provided with specially configured leaf traps which may be cleaned out at ground level.

10 Claims, 5 Drawing Figures

AUXILIARY DRAINAGE SYSTEM FOR ELIMINATING WATER PROBLEMS ASSOCIATED WITH A FOUNDATION OF A BUILDING

REFERENCE TO RELEVANT PATENT

Reference is made to the following patent, the disclosure of which is incorporated herein for its teaching of the best and most accepted technique utilized in present-day practice for thoroughly repairing and waterproofing the foundation of a building, and for preventing the reoccurrence of ground water problems associated with a foundation of a building, namely U.S. Pat. No. 4,136,500 issued Jan. 30, 1979 to Dante DiFiore of Highland Heights, Ohio 44143.

BACKGROUND OF THE INVENTION

1. Field of the Invention

The present invention relates generally to an auxiliary drainage system for relieving and eliminating water problems associated with the foundation of an existing building, and, more particularly, to a method for dealing with ground water problems without the need to carefully hand-dig a trench immediately adjacent the exterior surface of the foundation to expose the exterior surface of the foundation to permit its being treated and waterproofed.

2. Prior Art

Accepted conventional waterproofing techniques call for a trench to be dug carefully, usually by hand, immediately adjacent to the exterior surface of the foundation of a building to expose the foundation's exterior surface for repair and treatment. The ditch is dug to a level below that of the top of the basement floor of the building to expose and permit servicing of the building's footer drain tile system. If the footer drain tile system is found to be clogged or in need of repair, appropriate steps are taken to put this system back into good operating condition.

When such a trench must be dug, it may be necessary to temporarily remove, and sometimes destroy, existing bushes, trees and other foundation plantings. Sometimes the digging of such a trench also requires removal and rebuilding of sections of sidewalks, stairs and driveways. In other situations, it is possible to gain access to the required area of foundation wall by tunneling under some of the foundation plantings and/or such existing structures as extend alongside the foundation. Digging the necessary trenches and tunnels is a time consuming and relatively expensive undertaking which usually must be done by hand. Power equipment such as a backhoe usually cannot be used to perform this work in view of the delicate nature of the work and the possibility of damage to the building.

A problem with all storm drainage systems is that particulate material such as leaves, small pieces of roofing and other kinds of debris tend to enter the system through downspouts. This particulate material accumulates in storm drainage tile and diminishes the effective size of the tile. TABLE 1 presents a tabulation of the square feet of roof area which can be served by various nominal sizes of drain tile laid at slopes of ⅛ inch, ¼ inch and ½ inch per foot of length of the tile, respectively, assuming a four inch per hour downpour. If half of the operable diameter of a drain tile is blocked by an accumulation of debris, its effective carrying capacity will be cut in half and, as a minimum, the figures presented in TABLE 1 will need to be halved. Moreover, in the presence of a very significant downpour, some of the debris may be transported from place to place in a drain line, and may tend to collect at a common location causing a blockage of the entire system.

TABLE 1

Square footage of roof are served by tile of various nominal sizes laid at slopes of ⅛ inch, ¼ inch and ½ inch per foot of tile length.

| Nominal Diameter of Drain Tile | Square Footage of Roof Area Served | | |
|---|---|---|---|
| | ⅛" per ft | ¼" per ft | ½" per ft |
| 3 | 822 | 1,160 | 1,644 |
| 4 | 1,880 | 2,650 | 3,760 |
| 5 | 3,340 | 4,720 | 6,680 |
| 6 | 5,350 | 7,550 | 10,700 |
| 8 | 11,500 | 16,300 | 23,000 |
| 10 | 20,700 | 29,200 | 41,400 |
| 12 | 33,300 | 47,000 | 66,600 |
| 15 | 59,500 | 84,000 | 119,000 |

While the installation of gutter guards and gutter-carried screens is helpful in diminishing the quantity of debris washed into drain lines through downspouts, the quantity of debris which continues to enter drain lines is unacceptably high and significantly reduces the capacity of these lines.

3. The Referenced Patent

The disclosure of the referenced patent is incorporated herein inasmuch as it presents the best and most accepted technique utilized in present-day practice for thoroughly repairing and waterproofing the foundation of an existing building, and for preventing the reoccurrence of ground water problems associated with a foundation of a building. The referenced patent relates to a method of overcoming the problem of water seeping into the basement of a dwelling or other building structure, whereby (1) the foundation is treated to fill its hollow spaces, especially hollow spaces in the vicinity of cracks or other structural damage or deterioration, (2) the footer drain line system of the building is serviced and restructured if need be to put it in proper form for trouble-free operation, (3) clean-outs are provided at spaced locations around the foundation for future checking and servicing of the footer drain line system, and (4) porous reservoirs are formed from particulate material such as stone in lower portions of the trenches or tunnels which have been dug about the foundation of the building. The porous reservoirs provide a system of open passages for ducting water to the footer drain line system, and for providing regions where water may temporarily accumulate harmlessly in a situation of heavy rainfall or backup of the storm drain line which serves the building.

The referenced patent also discusses the advantages which can result from constructing a manhole at the juncture of the footer drain line system and the storm drain line. In some situations it is desirable to install a check valve in the storm drain line at the location of the manhole to prevent the storm drain line from backing up into the building's footer drain line system. In other situations, it is desirable to have the footer drain line system discharge directly into the manhole, and to utilize a sump pump to transfer water from the manhole to the storm drain line.

While the waterproofing system disclosed in the referenced patent continues to represent the most preferred approach to take in dealing with basement waterproofing problems, there are situations where the digging of a ditch immediately adjacent the outer face of a foundation wall is unduly expensive and/or would unacceptably require the removal or destruction of valuable foundation plantings or existing structures. The present invention addresses these situations.

SUMMARY OF THE INVENTION

The present invention overcomes the foregoing and other drawbacks of prior proposals by providing a novel and improved method for relieving and eliminating water problems associated with a foundation of an existing building. The system of the present invention addresses the need for an approach which can be used either in place of conventional waterproofing techniques, or together with conventional waterproofing techniques to eliminate the need to dig a trench and/or tunnel immediately adjacent the exterior surface of at least a portion of a foundation wall.

In accordance with the preferred practice of the present invention, a method of relieving or eliminating water problems associated with the foundation of a building includes the steps of laying an auxiliary drain line in a trench which has been dug to extend about lower foundation portions of a building, but at a location spaced several feet from the foundation. The newly laid auxiliary drain line is preferably connected to a storm drain line that serves the building so that water which enters the auxiliary drain line is discharged into the storm drain line. The storm drain line may connect with a city storm drain or may discharge into a creek or onto some other suitable watershed.

The tile-carrying trench is filled with loose particulate matter such as stone, except for its very top portion which is filled with topsoil. The particulate-filled portion of the trench provides a porous region which serves to (1) duct water to the auxiliary drain line, (2) eliminate ground water pressure buildup near the foundation wall, and (3) provide a ground water reservoir during an excessively heavy rainfall when the storm drain line may not be capable of carrying away all of the rainwater. An advantage of the porous reservoir is that the maze of passages provided by the reservoir for channeling water to the auxiliary drain line do not freeze shut during winter and thereby remain operable year round to eliminate and relieve water problems. A further advantage of the porous reservoir is that it tends to cut off the flow of ground water to the vicinity of the foundation, and to duct this ground water into the auxiliary drain line, whereby the ground near the foundation stays drier as does the foundation wall itself.

By utilizing a trench located several feet from the outer wall of the building, the need to remove or tunnel under many foundation plantings and existing structures such as stairs, sidewalks and driveways is avoided, and power-operated equipment can be used without the usual concern that such equipment will accidentally strike or otherwise do damage to the building.

The trench is dug to a depth below that of the basement floor of the building, and the auxiliary drain line is laid in the trench at a level below the top of the basement floor of the building to assure that ground water near the foundation will be carried away before it reaches a height that will cause seepage into the basement. Preferably the trench is also dug to a depth below that of nearby portions of the building's footer drain line system which extends along the foundation of the building (1) so that the auxiliary drain line can be installed at a level below that of nearby portions of the footer drain line system, and (2) so that branch lines may be installed in tunnels to interconnect the auxiliary drain line with the footer drain line system. The branch lines direct water from the building's footer drain line system to the auxiliary drain line, whereby maximum use is made of the building's footer drain line system, even if portions of it are damaged and/or clogged.

In the event the storm drain line is found to be positioned too high to permit the auxiliary drain line to discharge into it properly, (1) a manhole is constructed, (2) the auxiliary drain line is connected to discharge into the manhole, and (3) a sump pump is provided in the manhole for transferring water from the manhole to the storm drain line. In situations where there is a continuing problem with the storm drain line backing up, a check valve is preferably installed in the storm drain line to prevent it from backing up.

Such ones of the building's downspouts as are found to be connected to inoperable storm drain line branches are rerouted and connected to the auxiliary drain line. Additionally, the building's downspouts are preferably provided with specially configured leaf traps which may be cleaned out at ground level. The leaf traps are constructed to permit their being installed in place of removed downspout sections, and have pivotally-mounted doors which may be opened easily to permit collected debris to be removed. The doors are biased toward their closed positions but open automatically in the event the debris collection areas of the traps become full, whereby the leaf traps are self-cleaning in character and prevent the entry into drain lines of leaves, small pieces of roofing, and other debris which might lead to the formation of blockages in the drain lines.

DESCRIPTION OF THE PREFERRED EMBODIMENT

Figure 1:
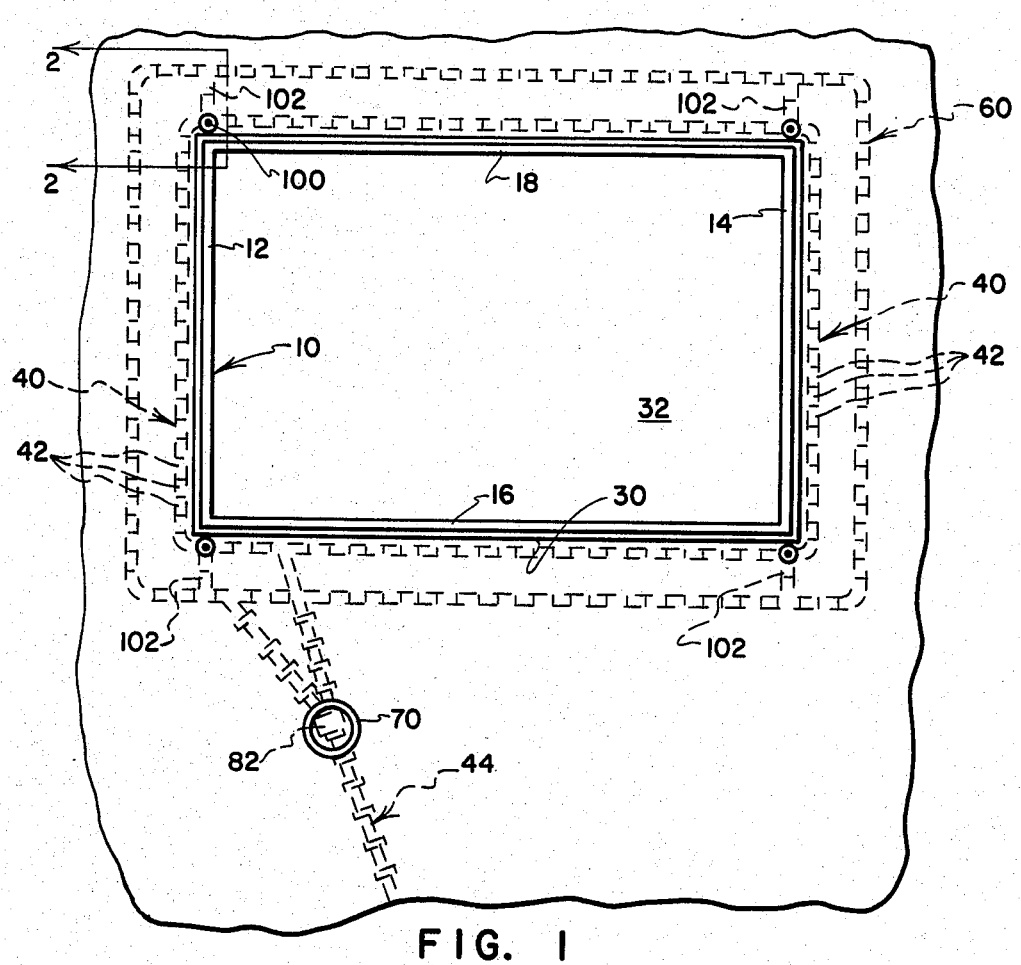
FIG. 1 is a top plan view of a basement wall of a building showing the building's footer drain line system, an auxiliary drain line system installed several feet from the foundation of the building, branch lines interconnecting the footer and auxiliary drain lines, and a manhole containing a check valve installed in the storm drain line.
Figure 2:
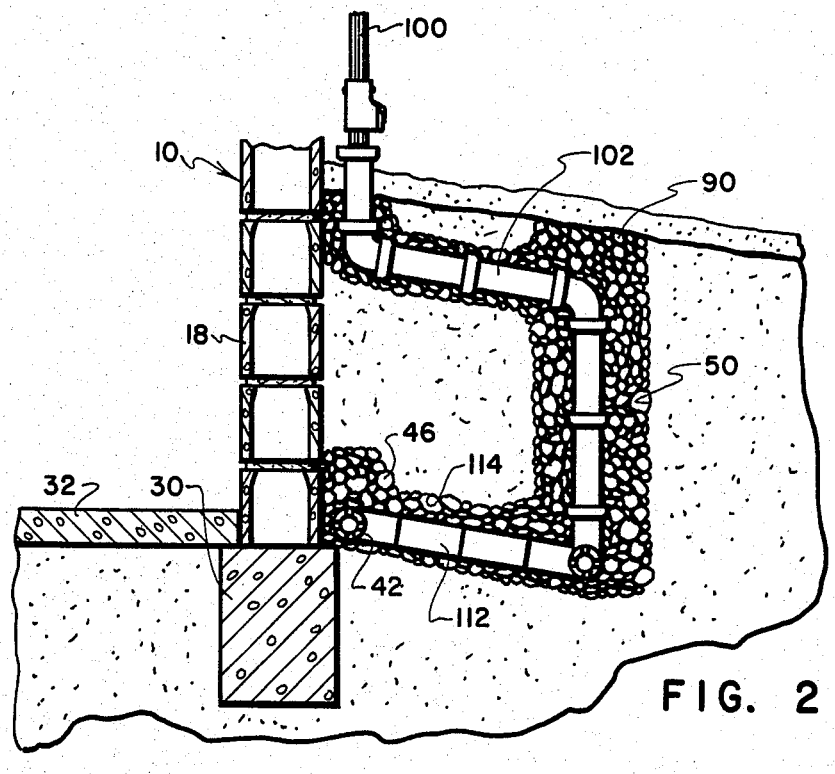
FIG. 2 is an enlarged sectional view, as seen from a plane indicated by a line 2—2 in FIG. 1, showing the rerouting of a downspout for connection to the auxiliary drain line, as well as the installation of a branch line to interconnect the auxiliary drain line with the building's footer drain line system.

Referring to FIG. 1, a basement foundation wall of a dwelling or other type of building is indicated generally by the numeral 10. The foundation wall 10 includes sidewalls 12, 14, and front and back walls 16, 18. Referring to FIG. 2 which presents a typical section through the foundation wall 10, a poured concrete footer 30 underlies the wall 10. A poured concrete floor 32 has portions overlying the inner sides of the footer 30 and extending into abutting engagement with all portions of the foundation wall 10.

A footer drain line system, indicated generally by the numeral 40, extends about the foundation footer 30. While the footer drain line system 40 is typically formed from a plurality of conventional, elongate drain tile 42 arranged end-to-end to establish a continuous conduit extending perimetrically around outer portions of the footer 30, it may be formed from other materials such as plastic conduit which is perforated at spaced intervals to admit surrounding ground water. The footer drain line system 40 is graded to drain, by gravity, into a storm drain line, indicated generally by the numeral 44. The storm drain line 44 may connect with a city storm sewer, or may drain into a creek or onto a suitable watershed.

A porous bed of particulate material 46, typically comprised of slag or stone, is provided about the tiles 42 of the footer drain line system 40 to assure that an intricate network of open passages will channel ground water from the vicinity of the foundation wall 10 into the footer drain system 40. Additionally, the porous bed 46 normally provides something of a reservoir within which ground water can be received and temporarily retained during a particularly intense storm when the capacity of the storm drain line 44 may be exceeded, or the storm drain line 44 may back up.

While the foundation wall 10 is illustrated as being formed from conventional, hollow concrete blocks, it will be understood that the wall 10 may be formed from other hollow materials such as tile, or may be partially or completely solid in character, as is the case where the wall is formed from bricks or poured concrete. Neither the structure of the foundation wall 10 nor the construction of the footer drain line system 40 are important to the present invention, for the principles of the present invention are sufficiently versatile to permit their use in conjunction with practically all types of foundation wall constructions as well as a wide variety of footer drain line system constructions.

While accepted conventional waterproofing techniques would call for a trench to be dug carefully, as by hand, immediately adjacent the exterior surface of the foundation wall 10 to permit repair and treatment of the foundation wall, and to expose the footer drain tile system 40 for service and repair, the technique of the present invention requires the digging of no such trench and does not deal with basement seepage problems by treating the foundation wall 10. Instead, the technique of the present invention calls for the digging of a trench 50 (see FIG. 2) along but spaced from such portions of the foundation wall 10 as have been found to present seepage or dampness problems, but at a location that is spaced from the foundation wall 10, preferably at a distance of between about two to eight feet. The trench 50 may be curved or otherwise configured to skirt foundation plantings and existing structures such as stairs, sidewalks and driveways.

By positioning the trench 50 at locations spaced from the foundation wall 10, it is possible to dig at least a majority of the trench 50 using power equipment such as a backhoe without concern that this equipment will damage the building. By using power equipment, the trench 50 can be dug quickly and at a much lesser cost than is incurred if a trench must be dug by hand immediately adjacent the wall 10.

An auxiliary drain line 60 is laid in the trench 50 at a level below that of the basement floor 32, and preferably at a level below that of nearby portions of the footer drain line system 40. The auxiliary drain line 60 is preferably formed from elongate tile 62 laid end-to-end, but may be formed from other suitable materials such as plastic conduit which is provided with perforations at spaced interals along its length to admit ground water from the general vicinity of the foundation wall 10.

Figure 3:
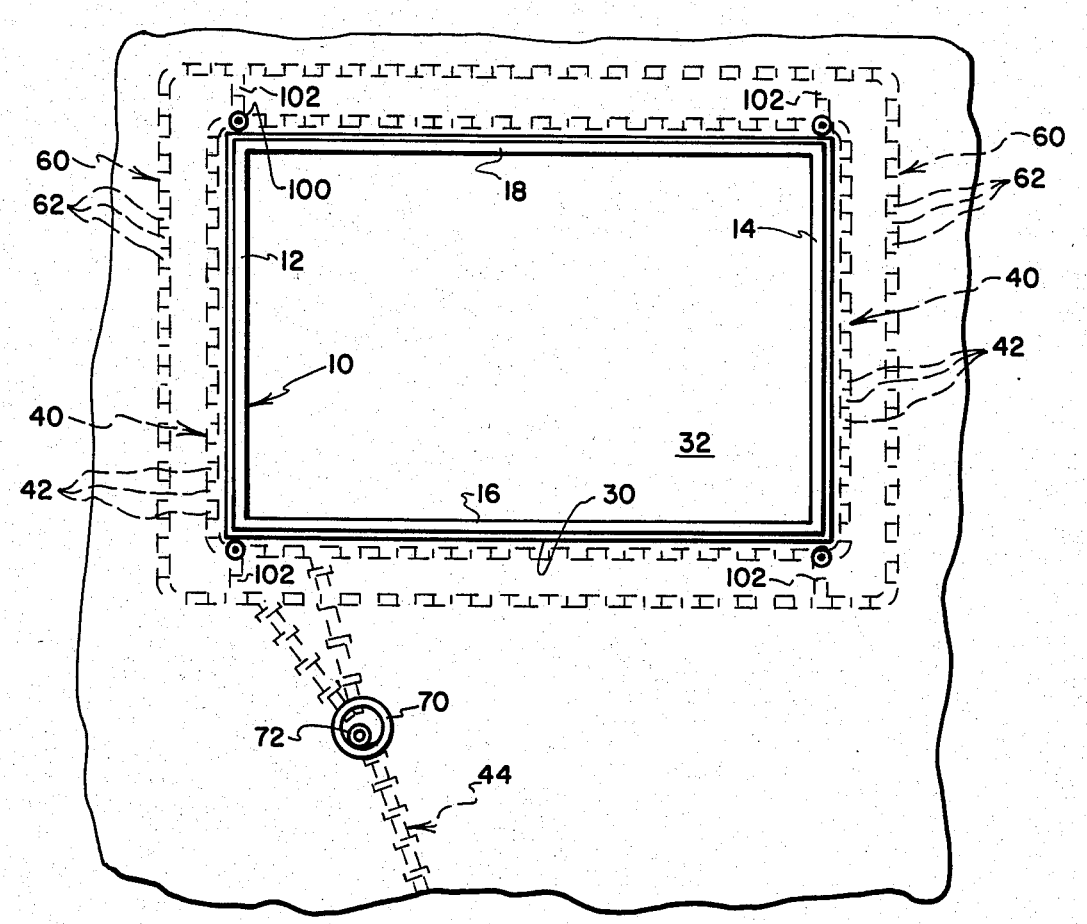
FIG. 3 is a top plan view similar to FIG. 1 showing an alternate form of practice of the present invention wherein a sump pump is installed in a manhole to discharge water from the auxiliary and footer drain lines into the storm drain line.

The auxiliary drain line 60 is arranged to drain toward the storm drain line 44. A connection is made between the auxiliary drain line 60 and the storm drain line 44 so that water which has entered the auxiliary drain line 60 will be discharged into the storm drain line 44. If the auxiliary drain line 60 is found to be positioned at a level which is too low to permit draining, as by gravity, of water from the auxiliary drain line 60 into the storm drain line 44, (1) a manhole structure 70 is formed at the juncture of the storm and auxiliary drain lines 44, 60, as is shown in FIG. 3, (2) the auxiliary drain line 60 is connected to discharge into the manhole structure 70, and (3) a sump pump 72 is provided in the manhole structure 70 to transfer water from the manhole structure 80 into the storm drain line 44. If the storm drain line 44 has a history of backing up, (1) a manhole structure 70 is preferably formed at the juncture of the storm and auxiliary drain lines 44, 60, as is shown in FIG. 1, and (2) a check valve 82 is installed in the manhole structure 70 to prevent backup problems.

Referring to FIG. 2, the trench 50 is filled to within its top few inches with a material such as stones or slag to provide a porous reservoir 90 which will channel water to the auxiliary drain line 60. The reservoir 90 also acts to prevent the buildup of ground water pressure within the vicinity of the foundation wall 10 by channeling ground water to the auxiliary drain line 60. In the event that a particularly heavy rain provides a flow of water into the auxiliary drain line 60 which exceeds its capacity, the reservoir which surrounds the drain line 60 provides a region in which water can accumulate harmlessly until it can be carried away by the auxiliary drain line 60. An advantage of the porous reservoir 90 is that its many intricate passages do not freeze shut in winter, whereby the reservoir 90 remains functional year round.

As is illustrated in FIG. 2, downspouts such as the downspout 100 which are found to be connected to a clogged drain line branch (not shown), may be rerouted and connected by a branch line 102 to the auxiliary drain line 62. Additionally, in order to take maximum advantage of the building's footer drain line system, one or more branch lines 112 may be installed in underground tunnels 114 to interconnect the footer drain line system 40 with the newly installed auxiliary drain line 60. By this arrangement, even if portions of the footer drain line system 40 are damaged or clogged, such portions as are operable may be utilized to transfer water to the auxiliary drain line 60.

Figure 4:
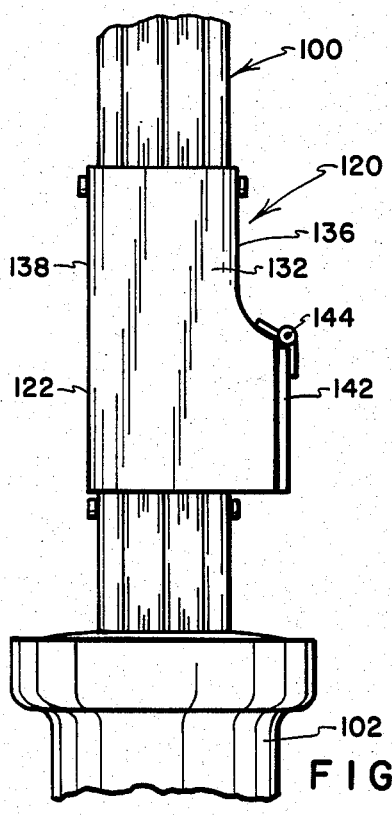
FIG. 4 is an enlarged side elevational view of a portion of the downspout shown in FIG. 2, the downspout having a self-cleaning leaf trap installed thereon; and, FIG. 5 is a sectional view, on an enlarged scale, as seen from a plane indicated by a line 5—5 in FIG. 1, showing details of the inner structure of the leaf trap, but with the discharge door of the leaf trap in an open position.
Figure 5:
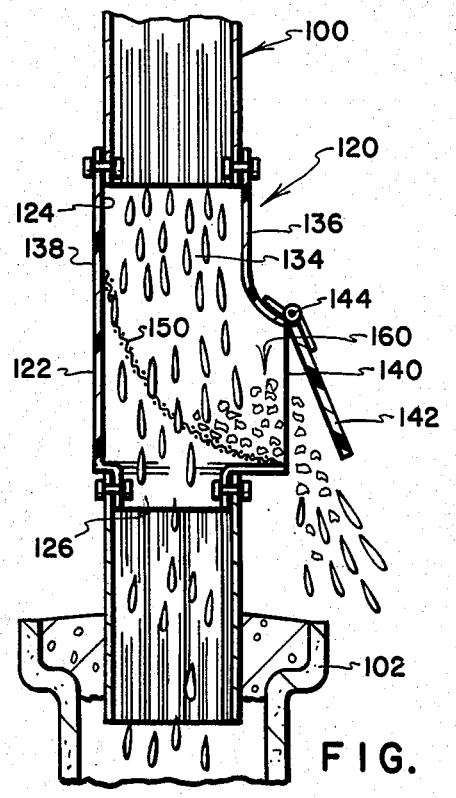

Referring to FIGS. 4 and 5, the downspouts of the building, such as the downspout 100, are preferably provided with self-cleaning leaf traps 120 which are accessible at ground level for cleaning and servicing. The leaf traps 120 each have an outer housing 122 which is preferably formed from a corrosion-resistant material such as plastics or aluminum. The housing 122 has an inlet opening 124 defined at its upper end for connection to a downspout 100, and an outlet opening 126 defined at its lower end for connection to an extension of the downspout 100. The housing 120 has side walls 132, 134 and front and back walls 136, 138. A discharge opening 140 is formed in the front wall 134. A spring-biased closure 142 is provided for releasably closing the discharge opening 140. The closure 142 is pivotally connected to the housing 122 by a pivot pin 144.

A porous screen 150 is provided within the housing 122. The screen 150 has openings of suitable size formed therethrough for permitting water to pass, substantially without obstruction, from the inlet opening to the outlet opening, but which will channel leaves, small pieces of roofing materials, and other debris toward a collection position 160 adjacent the closure 142. In the event a collection of these trapped materials builds up adjacent the closure 142, the pressure of water passing through the housing 122 will, during a heavy rainfall, cause the closure 142 to be biased open briefly, as is illustrated in FIGS. 5, to discharge the built-up collection of debris. Alternatively, the near-ground-level position of the leaf trap 120 provides ready access for a home-owner or maintenance person to open the closure 142 and clean out any accumulated debris.

As will be apparent from the foregoing description, the present invention provides a novel and improved system for relieving or eliminating water problems associated with the foundation of a building. The system of the invention requires no digging or trenches or tunnels adjacent the exterior surface of a foundation wall, nor does it require any treatment whatsoever of the foundation wall itself. While the technique of the present invention may be substituted for conventional waterproofing techniques to treat the entire foundation of a building, it also may be utilized selectively together with conventional waterproofing techniques to treat only selected areas of a foundation wall.

Although the invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of relieving and eliminating ground water buildup near at least a portion of a foundation wall of a building, wherein the building has a basement floor that is internal with respect to the foundation wall, and wherein the basement floor has a top surface, and wherein the building has a footer drain line system extending along the foundation wall portion, including the steps of:

(a) digging a trench at a location that is external with respect to and extending along but spaced a substantial distance on the order of several feet laterally outwardly from an underground wall which forms a portion of a foundation wall of a building, the trench extending to a depth below the height of a top surface of a basement floor of the building;

(b) installing an elongate auxiliary drain line means in the trench at a level below that of the height of the top surface of the basement floor of the building and at a level below that of nearby portions of the footer drain line system, with the auxiliary drain line means being similarly spaced a substantial distance from and external to the underground wall for providing openings at spaced locations along the elongate auxiliary drain line means to admit water from a surrounding area that is external with respect to the undergrond wall into the auxiliary drain line means, including establishing at least one branch line connection between the auxiliary drain line means and the nearby footer drain line portions so that water may discharge from the footer drain line system through the branch line connection into the auxiliary drain line means;

(c) providing means for connecting the auxiliary drain line means to a storm drain line which serves the building so that water which is admitted to the auxiliary drain line means is channeled into the storm drain line; and, (d) filling substantially all but the topmost few inches of the trench with particulate material to provide porous reservoir means surrounding the auxiliary drain line means at a location which is external with respect to the underground wall and extending upwardly from the auxiliary drain line means for receiving ground water and ducting it to the auxiliary ground drain line means to prevent the buildup of ground water in the vicinity of the foundation wall portion.

2. The method of claim 1 wherein the step of establishing at least one branch line connection between the auxiliary drain line means and the footer drain line system includes the steps of:

(a) digging an underground tunnel from a lower portion of the trench to the vicinity of the footer drain line system; and, (b) positioning a connecting conduit in the tunnel at an angle of incline extending downwardly from a point of connection with the footer drain tile system to a point of connection with the auxiliary drain line means.

3. The method of claim 1 wherein the step of providing means for connecting the auxiliary drain line means to the storm drain line includes the step of constructing a manhole at a location of the connection between the auxiliary drain line means and the storm drain line.

4. The method of claim 3 wherein, should the storm drain line be found to be positioned too high for the auxiliary drain line means to define by gravity into the storm drain line at the location of the manhole, the auxiliary drain line means is connected to drain into the manhole, and a sump pump is provided in the manhole to transfer water from within the manhole to the storm drain line.

5. The method of claim 3 wherein, should the storm drain line have a history of backing up into the footer drain line system, a check valve is installed in the storm drain line within the confines of the manhole to prevent such backups.

6. The method of claim 1 wherein the building has at least one downspout, and the method further includes the step of installing a branch conduit to duct water from the downspout into the auxiliary drain line.

7. The method of claim 1 wherein the building has at least one downspout, and the method further includes the step of installing a leaf trap in the downspout at a near-ground-level location.

8. The method of claim 8 wherein the step of installing a leaf trap includes the steps of:

(a) providing a leaf trap having a housing with an upper end, a lower end, an inlet near the upper end, an outlet near the lower end, a discharge opening located intermediate the inlet and the outlet, a closure for closing the discharge opening, and screen means carried in the housing for passing water through the housing from the inlet to the outlet, and for directing leaves, pieces of roofing and other debris toward a collection position located near the discharge opening; and (b) positioning the leaf trap to receive water through the inlet from an upper portion of the downspout, and to discharge water from the outlet into a lower portion of the downspout.

9. The method of claim 8 wherein the step of providing a leaf trap additionally includes the step of providing means biasing the closure toward a position closing the discharge opening.

10. The method of claim 8 wherein the step of providing a leaf trap having screen means includes the step of providing a screen extending in an inclined manner across the path of flow and being operable to direct water from the inlet opening toward the discharge opening should a substantial buildup of debris occur within the housing for opening the closure and for discharging at least a portion of the collected debris through the discharge opening.

* * * * *